United States Patent [19]

Marshall

[11] Patent Number: 4,559,875

[45] Date of Patent: Dec. 24, 1985

[54] HIGH ENERGY SWITCHING CIRCUIT FOR INITIATOR MEANS OR THE LIKE AND METHOD THEREFOR

[75] Inventor: William F. Marshall, Belmont, Calif.

[73] Assignee: Quantic Industries, Inc., San Carlos, Calif.

[21] Appl. No.: 591,202

[22] Filed: Mar. 19, 1984

[51] Int. Cl.[4] ..... F42C 11/00

[52] U.S. Cl. ..... 102/218; 102/206

[58] Field of Search ..... 102/206, 218, 220, 219; 315/209 T, 209 CD; 361/248

[56] References Cited

U.S. PATENT DOCUMENTS

| | | | |
|---|---|---|---|
| 3,001,477 | 9/1961 | Ruehlemann | 102/218 |
| 3,787,740 | 1/1974 | Salton et al. | 102/220 |
| 3,885,501 | 5/1975 | Schneider, Jr. | 102/218 |

*Primary Examiner*—Charles T. Jordan

*Attorney, Agent, or Firm*—Flehr, Hohbach, Test, Albritton & Herbert

[57] ABSTRACT

A high energy switching circuit for an initiator, for example, an exploding bridgewire (EBW) or slapper-type detonator, includes a charged capacitor which is placed across a pair of series diodes connected in a reverse standoff voltage mode with respect to the capacitive voltage in series with an EBW initiator circuit. A switching field effect transistor is connected in shunt across the lower diode. In the armed condition, the pair of diodes clamp the high energy capacitor voltage at their reverse avalanche voltage. Upon the activation of the switching transistor, the capacitor voltage is impressed across the upper diode and a high reverse current flows through the upper diode placing it in destructive conduction which immediately also forces the other diode into destructive conduction to complete the series circuit from the capacitor to the EBW or slapper detonator. The circuit comprises low cost components and features very good firing simultaneity between similar firing circuits.

12 Claims, 4 Drawing Figures

HIGH ENERGY SWITCHING CIRCUIT FOR INITIATOR MEANS OR THE LIKE AND METHOD THEREFOR

The present invention is directed to a high energy switching circuit for initiator means or the like and a method therefor and more specifically to a circuit especially useful for triggering exploding bridgewire (EBW) initiators and slapper detonators which are used in rockets, missiles, and explosive initiation applications.

Prior EBW and slapper detonator systems have used a spark gap tube which is connected in series with it to switch the energy from a high voltage storage capacitor. When this capacitor is charged, for example, to 3000 volts, a trigger is applied to the spark gap tube which turns the tube on and thus a surge current of, for example, 3000 amperes will flow. The difficulty with this type of triggering apparatus is its relatively large size and high volume. Here where rise time is of crucial importance, the large size means that is is difficult to minimize circuit inductance and take advantage of techniques utilizing low inductance strip-line capacitors. Thus, to compensate for the increased inductance, higher voltage sources and larger capacitors are required.

The above type of circuit may also use various types of current blocking devices such as built-in back-to-back diodes in the EBW circuit to prevent false actuation by picked-up electro-magnetic induction. Other devices suggested have been second spark gaps and varistors.

Where the high spacial volume cannot be tolerated, such as in tactical missiles which have little space, the present firing means used are fuse wire type initiators which are not entirely safe, or out of line safe-arm-fire devices which are mechanically complicated.

Thus, it is a general object of the present invention to provide an improved high energy switching circuit for initiator means.

In accordance with the above object, there is provided a high energy switching circuit for initiator means or the like, such as an exploding bridgewire or slapper detonator which includes a high voltage capacitor. A plurality of series connected junction diodes are connected in a reverse direction across the capacitor and also to the initiator means to form a series circuit. Each of the diodes has a reverse standoff voltage such that the increased current resulting from a greater voltage will result in irreversible damage and destructive conduction with the diodes thus forming a low resistance current path. A transistor switch is provided which has a control input and a pair of terminals which may be switched by the control input to an off and on condition.

One of the terminals is connected to the initiator means and the other to a midpoint between two of the diodes. Means are provided for charging the capacitor to a voltage substantially equal to the sum of the reverse standoff voltages. Finally, means are provided for applying a signal to the control input to turn on the transistor and shunt one or more of the diodes so that the capacitor is impressed upon the remaining diodes. Since this impressed voltage is much greater than the standoff voltage, it places these diodes in destructive conduction which in turn places the shunted diodes in destructive conduction to complete the series circuit with the capacitor and initiator means whereby a surge of current passes through the initiator means.

An equivalent method is also provided.

Figure 1:
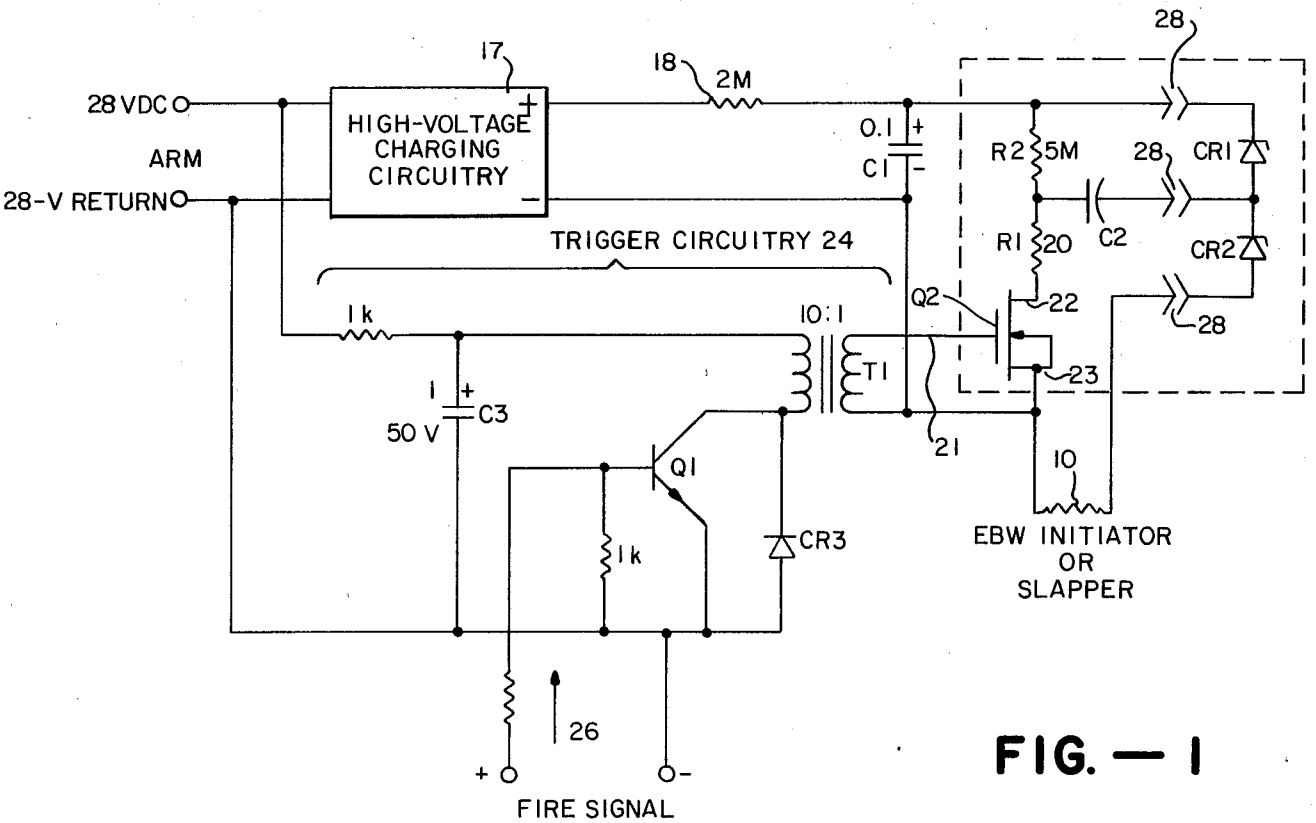
FIG. 1 is a circuit schematic embodying the present invention.

FIG. 1 illustrates the circuitry of the present invention which has as an object the exploding of the bridgewire of EBW initiator 10 or activation of the slapper detonator. To accomplish this, it is well known in the art that a large surge of current with a fast rise time must be applied to the thin wire of the EBW, or thin strip in the case of a slapper detonator, which forms the active part of the initiator. The voltage for operation of this circuit comes from the high energy capacitor C1 which may, for example, have a value of 0.1 microfarads. Connected in series across this capacitor is initiator 10 along with series diodes CR1 and CR2 which are connected with the same polarity, that is, anode-to-cathode, etc., and in a reverse direction to the voltage which will be impressed on capacitor C1 and which is shown with the plus minus polarity indications.

Figure 2:
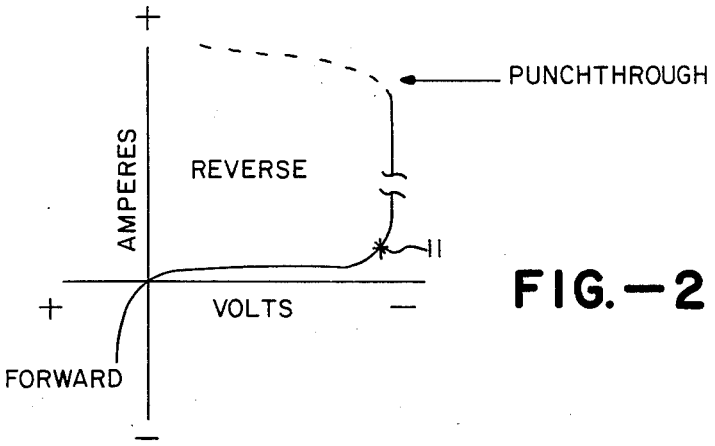
FIG. 2 is a characteristic curve of diode illustrating the operation of the invention.

Diodes CR1 and CR2 may, for example, be of the type 1N4249 manufactured by Unitrode. This diode has a reverse standoff voltage of approximately 1100 volts as indicated by the point 11 on the reverse curve of FIG. 2. Normally, of course, the diode is operated for conduction in the forward mode as shown by the forward curve. However, in the present invention, it will be operated in a reverse mode to destructive conduction. This is sometimes referred to as punchthrough in analogy to transistors. That is, the semiconductor fails into a conductive state. Thus, in FIG. 2 after the point 11 is reached and a greater voltage is applied, avalanching followed by irreversible damage will result where punchthrough or destructive conduction occurs and that diode forms a very low resistance current path.

Figure 3:
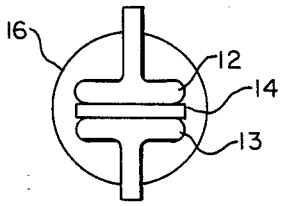
FIG. 3 is a simplified cross-section of a diode used in the invention.

Since thousands of amperes of current must be supplied to initiator 10 without the connections inside the diode fusing open, the type of diode utilized by the present invention is known in general as a junction diode. But more specifically, it is of the double heat sink type where the leads having a fairly large area of contact are fused directly to the semiconductor materials of the diode. This is illustrated in FIG. 3 where a typical diode is illustrated with the relatively large heat sink leads 12 and 13 fused to the semiconductor material 14, the entire diode being encased by the potting compound such as glass 16.

Now again referring back to FIG. 1, it is obvious that any of the individual diodes CR1 and CR2 may have substituted for them one or more additional series connected diodes. And, moreover, although the diodes are identical in the preferred embodiment and only a pair are used, dissimilar values with respect to reverse standoff voltages can be used.

Because of the high speed and high rise times desired in the present circuit, capacitor C1 is preferably a strip-line type which has an inherently low inductance of, for example, 2 to 5 nanohenries. Suitable capacitors are manufactured by Reynolds Industries of Santa Maria, Calif. Connected to capacitor C1 is high voltage charging circuitry 17 which converts an input voltage of 28 volts DC to approximately 3.0 kilovolts to charge the capacitor C1. The charging time constant due to the 2 megohm resistor 18, which is in series between the capacitor and charging circuitry, is approximately 0.2 seconds. The diodes CR1 and CR2 act as a shunt regulator or clamp to hold the voltage on capacitor C1 to approximately 2.2 kilovolts. Thus, after the capacitor is armed or charged (which is not done until just before the circuit is to be used and this is for safety purposes) the voltage across each diode is 1100 volts which is its reverse standoff voltage. This is point 11 of the reverse curve of FIG. 2. The clamping action, of course, occurs here because of the slight reverse current drain in the diodes at their clamping potential and the current limiting effect of the 2 megohm resistor 18. This resistor also allows for some variation in DC voltage supply in the arming circuit.

A transistor switch Q2 which is actually a power-type MOSFET (or metal oxide silicon field effect transistor) is effectively shunt connected across diode CR2. Transistor Q2 includes a control input 21 and a pair of switched terminals 22 and 23, the first being coupled through a resistor R1 and a capacitor C2 to the midpoint of diodes CR1 and CR2, and the other terminal 23 being connected to initiator 10 and to the other side of CR2. In the unoperated state, the transistor Q2 is in an open circuit condition. Transistor Q2 has a very fast switching time and a voltage rating of 500 volts and a pulsed current capability of 25 amperes. One type is available from International Rectifier under Model No. IRF840 and a similar metal cased high reliability type Model No. JANTX2N6770.

Since transistor Q2 has a voltage rating of 500 volts and the diode midpoint voltage is 1100 volts, a capacitor C2 is utilized to couple the connection 22 of the power FET to the midpoint of the diodes CR1 and CR2. In addition, resistor R1 has a very low impedance, for example, 20 ohms. Thus, when the MOSFET transistor Q2 is turned on, the peak current due to the substantially 530 volts which is on the transistor is approximately 25 amperes. A resistor R2 serves to bias connection 22 of the MOSFET at its breakdown potential (530 volts), this way providing the largest voltage swing from the MOSFET transistor that is attainable. This resistor has a very large value such as 5 megohms.

With a bipolar switching transistor of somewhat higher voltage rating (1500 volts), capacitor C2 and resistor R2 would not be necessary and the connection 22 can be joined straight to the midpoint of the diodes. Such a transistor would be a bipolar high voltage transistor such as a type available from Motorola under Model No. BN208. Such a transistor should still have a fast switching time but would switch as quickly as the power FET version described here. Simultaneity with this bipolar transistor is approximately 100 nanoseconds. In this embodiment, the switching speed of transistor Q2 is of major importance. Generally, the faster the transistor turns on, the faster the current rises in the upper diode CR1, and the faster the diodes avalanche. This speed of operation also tightens up the simultaneity.

To provide for isolation, a transformer T1 is connected to the control input 21 of Q2 to supply a control pulse which temporarily turns the transistor on or places it in closed circuit condition. The trigger circuitry connected to transformer T1 is indicated generally at 24 and includes on the line pair indicated at 26 a fire pulse which drives a transistor Q1. Capacitor C3 which is connected across transistor Q1 and the coupling transformer 21 is previously charged to 28 volts by the DC voltage supply to drive the control input of transistor Q2 with a turn on pulse when transistor Q1 turns on. Thus, Q2 is only momentarily closed or on. Appropriate resistive values are marked.

In operation, high energy capacitor C1 charges up to approximately 2.2 kilovolts at which point diodes CR1 and CR2 begin to conduct in the reverse direction to clamp the voltage across the capacitor at 2.2 kilovolts. Capacitor C2 assumes a charge voltage of approximately 1.1 kilovolts on the diode side and the breakdown voltage of the FET transistor drain (approximately 530 volts) on the side connecting to resistor R1. When a fire signal is applied at 26, transistor Q2 goes into a conductive state forcing approximately 25 amperes through diode CR1 in a reverse direction. The charge on capacitor C2 can be considered not to alter significantly during the brief period prior to the diodes avalanching because of this circuit's relatively long time constant. When the power FET turns on, the voltage at node 22 is forced from approximately 530 volts to less than 10 volts. Since the charge on capacitor C2 cannot change instantly, this 520 volt step is dropped across the 20 ohm resistor R1 causing a 25 ampere current to flow in the resistor R1, the diode CR1 and the power FET Q2.

With this excessive current in the reverse direction, diode CR1 avalanches and goes into full conduction because of its destruction. At almost the same time or while this is occurring, the diode CR2, because of the large current flowing due to the increased voltage which is thus placed across it also, breaks down by the same mechanism as diode CR1.

In an actual circuit test, a peak current in excess of 5000 amperes has been observed. During firing, some of the energy is imparted to the diodes cracking the glass housings of the diodes CR1 and CR2. This destruction does not affect the discharge currents since a metal arc is struck and the ends of the diodes cannot move apart significantly during the 10's of nanoseconds they are required to carry current.

Figure 4:
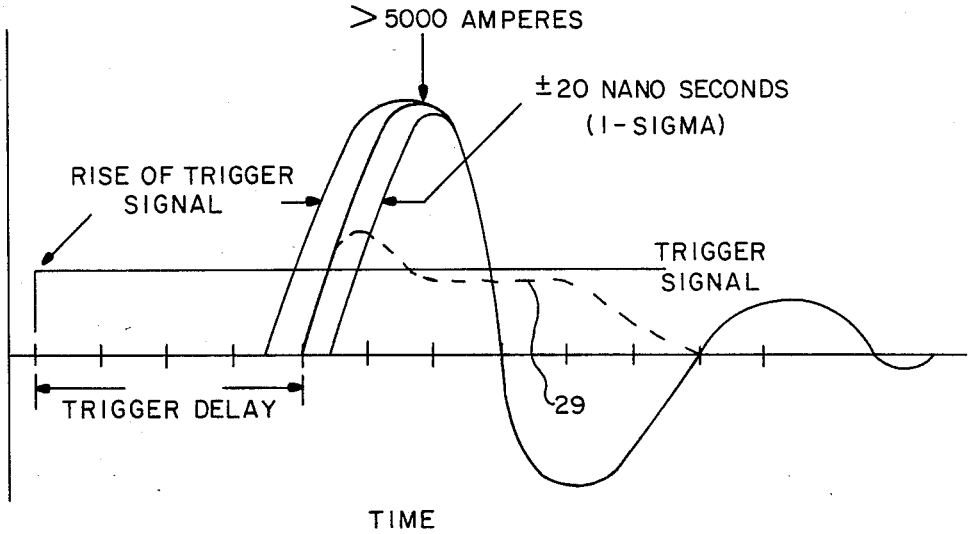
FIG. 4 is a timing diagram illustrating the operation of the present invention.

FIG. 4 illustrates the timing of the current waveform within the high energy discharge loop when a trigger signal is applied at pair 26. The trigger delay is the time taken for the transistor Q1 to turn on, the voltage to rise on the secondary of the transformer T1, the power FET Q2 to turn on and the diodes CR1 and CR2 to avalanche and break down. This time is typically 140 nanoseconds. The decaying sine wave waveform is the high energy discharge loop current with a current shunt substituted for the EBW/slapper detonator. The circuit rings because of the L-C resonant effect of the high energy capacitor and the discharge circuit's stray inductance. The limits of the 20 nanosecond time uncertainty (simultaneity) are indicated. The dashed curve 29 represents the current waveform with an EBW/slapper detonator in the discharge loop rather than a current shunt. The dip following the peak is due to the EBW/slapper detonator becoming a high resistance plasma.

As discussed above, in the present application, such simultaneity is of an utmost necessity in several applications such as, for example, where it is desired to form a directional pattern of detonation in a warhead.

The circuit of FIG. 1 also illustrates the plugs or connectors 28 by which diodes CR1 and CR2 may be easily inserted into the remaining circuitry. Of course, in missile and warhead applications, the entire circuit including the trigger circuitry and associated circuitry would be destroyed along with the missile or warhead. But circuits of this type must be tested several times before actual use. This procedure is absolutely essential. Thus, during a test, the two diodes are destroyed but a new pair can be plugged in. For such tests, the initiator means is shunted or replaced by a simulating circuit. And this is an effective testing procedure since (1) the diodes are very inexpensive and (2) the diodes per se can be tested separately and in any case have an exceedingly low failure rate.

One advantage of the present invention is that unlike a triggered spark gap tube as used in the prior art the present switch needs no hold-off voltage margin. There is a practically zero probability of inadvertent firing when the diodes conduct say 100 microamperes. Any conduction of this sort in a spark gap switch would probably cause it to break down and fire. Moreover, the unit cost of this circuit is relatively inexpensive since the components, for example, the diodes and field of effect transistors are relatively low cost.

One of the main advantages is the diodes, being naturally small, have very little parasitic inductance when wired in a circuit. This is because the forward and return conductors (one conductor being the path through the diodes) can be kept in close proximity since the diodes have a small radius; e.g., approximately 0.050 inch. The parasitic inductance of these small diodes (approximately 5 nanohenries) are already limiting the current in the high energy capacitor discharge loop slightly but significantly. The parasitic inductance of most spark gap switches when wired in a low inductance circuit (perhaps 20 nanohenries) cause severe attenuation of the discharge current and severely limit the current rise time. Because of the large inductance, most triggered spark gap switches add to the circuit and it is pointless to use them in these special low inductance strip-line applications.

Thus, an improved high energy switch circuit for an initiator of the EBW or slapper type has been provided.

I claim:

1. A high energy switching circuit for initiator means or the like comprising:

a high voltage storage capacitor;

a plurality of series connected junction diodes all connected in a reverse direction across said capacitor and said initiator means to form a series circuit, each of said diodes having a reverse standoff voltage such that a greater voltage will result in irreversible damage thereto and destructive conduction with such diodes forming a low resistance current path;

a transistor switch having a control input and a pair of terminals which may be switched by said control input to off and on conditions, one of such terminals being connected to said initiator means and the other terminal to a midpoint between two of said diodes;

means for charging said capacitor to a voltage substantially equal to the sum of said reverse standoff voltages;

means for applying a signal to said control input to turn on said transistor and shunt one or more of said diodes so that said capacitor voltage is impressed upon the remaining diodes which is much greater than said standoff voltages to thereby place them in destructive conduction which in turn places the shunted diodes in destructive conduction to complete said series circuit with said capacitor and initiator means whereby a surge of current passes through said initiator means.

2. A circuit as in claim 1 where said initiator means is an exploding bridgewire (EBW).

3. A circuit as in claim 1 where said initiator means is a slapper type.

4. A circuit as in claim 1 where said transistor switch is a power type MOS field effect transistor.

5. A circuit as in claim 1 where said junction diodes are of the double heat sink type where the leads are fused directly to the semiconductor materials of the diodes.

6. A circuit as in claim 1 where said control input includes transformer means for coupling such input to a control signal.

7. A circuit as in claim 1 where said diodes consist of first and second diodes, said first diode having one terminal connected to said capacitor and another terminal to said second diode and to a terminal of said transistor switch, the other terminal of said second diode being connected to said initiator means.

8. A circuit as in claim 1 where said diodes are plug mounted to the remainder of such circuit whereby such remainder can be easily tested.

9. A circuit as in claim 1 where said capacitor is of the strip-line type having low inductance.

10. A method of actuating initiator means with a high energy switching circuit with time precision which includes a high voltage storage capacitor;

a plurality of series connected junction diodes all connected in a reverse direction across said capacitor and connected to one side of said initiator means to form a series circuit, each of said diodes having a reverse standoff voltage such that a greater voltage will result in irreversible damage thereto and destructive conduction with such diodes forming a low resistance current path;

a transistor switch having a control input and a pair of terminals which may be switched by said control input to off and on conditions, one of such terminals being connected to said initiator means and the other terminal to a midpoint between two of said diodes;

including the steps of:

charging said capacitor to a voltage substantially equal to the sum of said reverse standoff voltages;

and applying a signal to said control input to turn on said transistor and shunt one or more of said diodes so that said capacitor voltage is impressed upon the remaining diodes which is much greater than said standoff voltages to thereby place them in destructive conduction which in turn places the shunted diodes in destructive conduction to complete said series circuit with said capacitor and initiator means whereby a surge of current passes through said initiator means.

11. A method as in claim 10 including the step of testing said circuit by applying said signal to destroy said diodes and then replacing only said destroyed diodes.

12. A method as in claim 10 where said signal to said control input is applied only momentarily.

* * * * *